US010979822B2

(12) United States Patent
Chen et al.

(10) Patent No.: US 10,979,822 B2
(45) Date of Patent: Apr. 13, 2021

(54) SPEAKER

(71) Applicant: AAC Technologies Pte. Ltd., Singapore (SG)

(72) Inventors: Minmin Chen, Shenzhen (CN); Xun Di, Shenzhen (CN); Bin Zhao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/711,392

(22) Filed: Dec. 11, 2019

(65) Prior Publication Data

US 2020/0213766 A1 Jul. 2, 2020

(30) Foreign Application Priority Data

Dec. 30, 2018 (CN) ..... 201822275881.4

(51) Int. Cl.

| | |
|---|---|
| ***H04R 9/06*** | (2006.01) |
| ***H04R 7/12*** | (2006.01) |
| ***H04R 7/18*** | (2006.01) |
| ***H04R 9/02*** | (2006.01) |

(52) U.S. Cl.

CPC ..... *H04R 9/06* (2013.01); *H04R 7/127* (2013.01); *H04R 7/18* (2013.01); *H04R 9/025* (2013.01); *H04R 2307/023* (2013.01); *H04R 2400/11* (2013.01)

(58) Field of Classification Search

CPC combination set(s) only.
See application file for complete search history.

(56) References Cited

U.S. PATENT DOCUMENTS

| | | | | |
|---|---|---|---|---|
| 2013/0156237 | A1* | 6/2013 | Kim | H04R 31/00 381/191 |
| 2018/0213330 | A1* | 7/2018 | Hou | H04R 7/18 |
| 2019/0238987 | A1* | 8/2019 | Zhang | H04R 9/025 |
| 2020/0196049 | A1* | 6/2020 | Zhang | H04R 9/06 |
| 2020/0213749 | A1* | 7/2020 | Chen | H04R 7/10 |
| 2020/0213751 | A1* | 7/2020 | Chen | H04R 9/06 |

* cited by examiner

*Primary Examiner* — Fan S Tsang
*Assistant Examiner* — Angelica M McKinney
(74) *Attorney, Agent, or Firm* — W&G Law Group LLP

(57) ABSTRACT

A speaker of the present invention arranges the grooves on the dome, which forms a leakage passage that helpful for the air current to circulate between the grooves and the voice coil, and therefore, the air current in the voice coil can timely circulate through the leakage passage between the voice coil and the dome. The inner and outer air pressure difference of the voice coil can be effectively decreased after the amplitude of the vibrating system increases, and the influence on the performance of the speaker imposed by the unbalance of the inner and outer air pressures of the voice coil is avoided.

18 Claims, 6 Drawing Sheets

SPEAKER

FIELD OF THE PRESENT DISCLOSURE

The present invention relates to the field of electro-acoustic transducers, particularly to a speaker used in an electronic device.

DESCRIPTION OF RELATED ART

With the continuous increase of market demand, electronic devices such as mobile phones, etc., are gradually developing towards thin type, and their sound quality is required to be better and better, which requires the acoustic devices in mobile phones to develop towards the direction of micro-size, thin type and high sound quality. Diaphragm is the core component of the speaker and other acoustic devices, so the requirement on its acoustic performance increases accordingly.

The speaker of relevant technologies comprise a frame, and a magnetic circuit system and a vibrating system in the frame, wherein the vibrating system comprise a diaphragm fixed on the frame and a voice coil fixed on the frame. The voice coil is inserted in the magnetic gap of the magnetic circuit system and directly abuts against the diaphragm. In the speaker structure, the voice coil directly abuts against and fully fits the diaphragm at the abutting position, and therefore, the voice coil needs to be elongated to ensure magnetic flux to guarantee enough space between the magnetic bowl and the dome in the thin-type development process of the speaker. A larger space is needed after the amplitude of the diaphragm increases, the air current in the voice coil cannot circulate in time, and the strength of a conventional alloy dome is insufficient, thus, the speaker performance is badly influenced.

Thus, it is necessary to provide an improved speaker to solve the problems above.

BRIEF DESCRIPTION OF THE DRAWINGS

Many aspects of the exemplary embodiments can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

Figure 1:
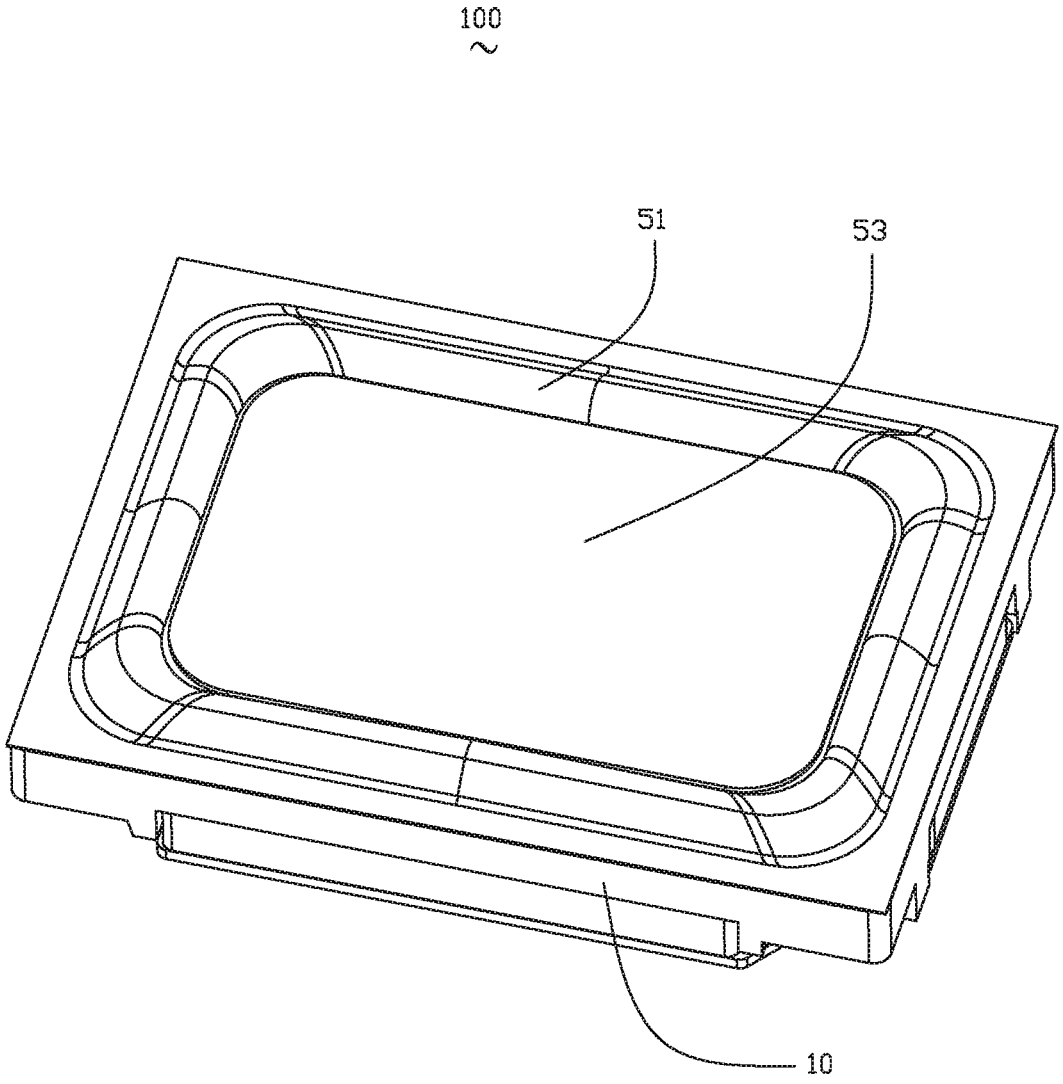
FIG. 1 is an isometric view of a speaker in accordance with a first exemplary embodiment of the present invention.
Figure 2:
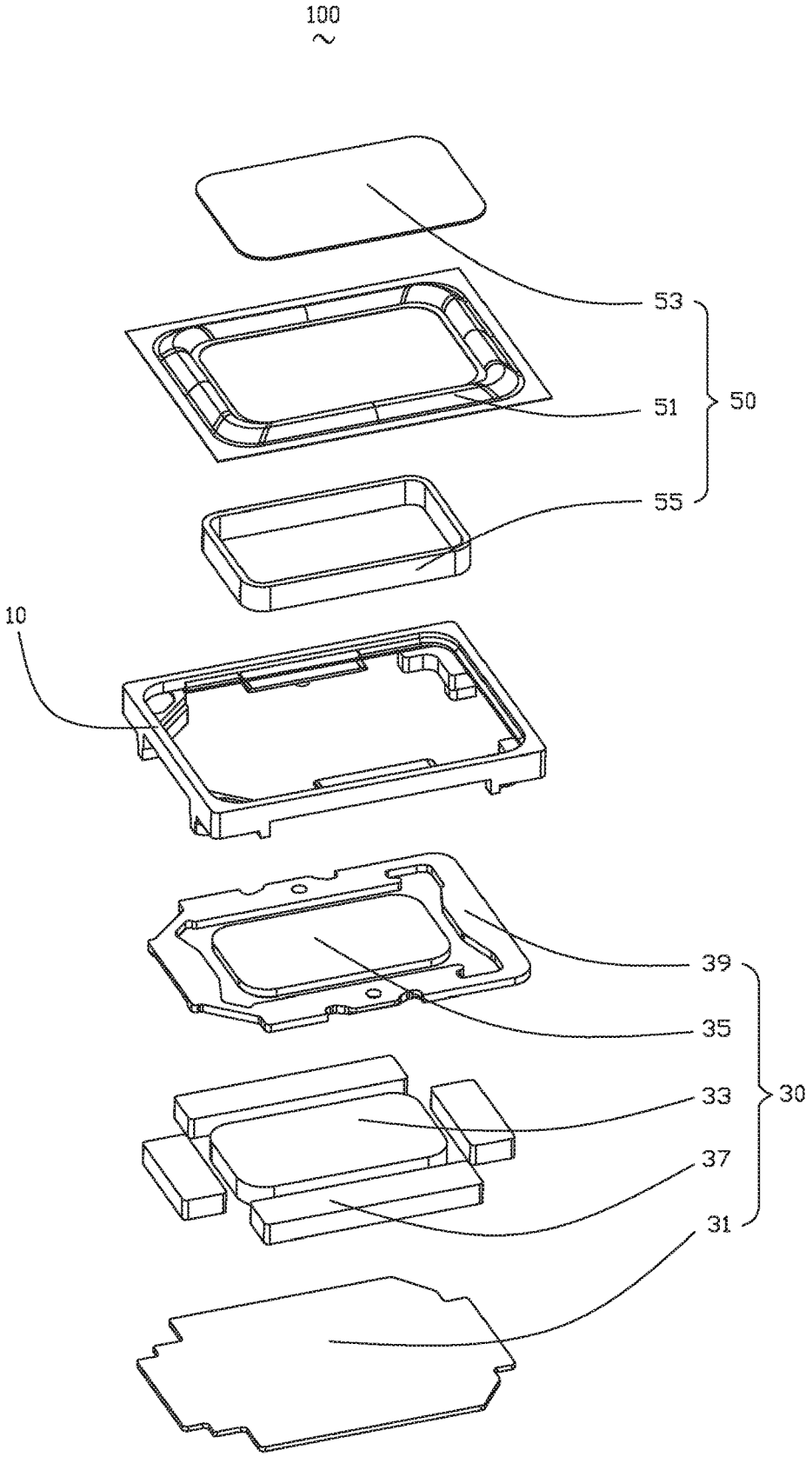
FIG. 2 is an exploded view of the speaker in FIG. 1.
Figure 3:
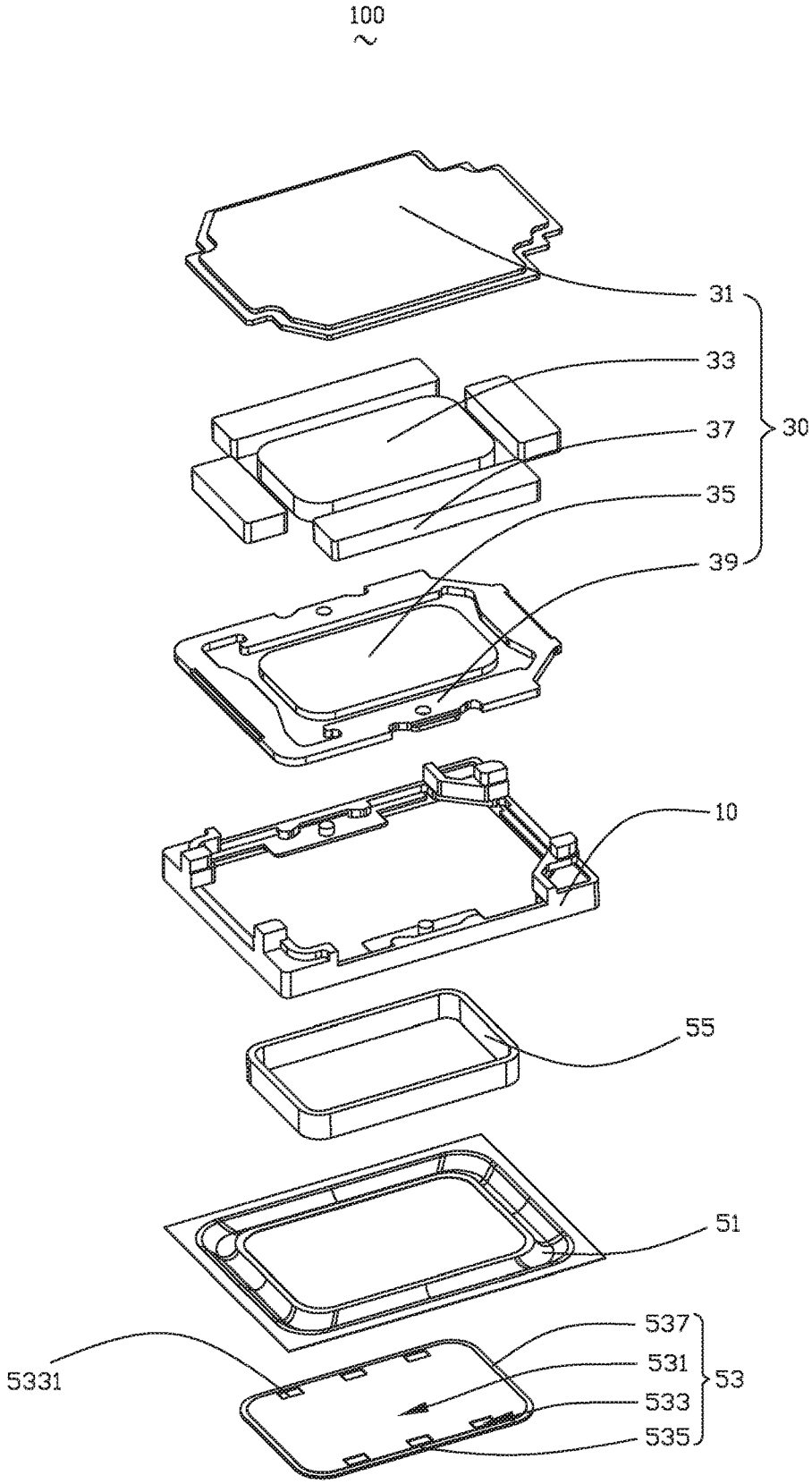
FIG. 3 is similar to FIG. 2, but showing the exploded view of the speaker from another aspect.
Figure 4:
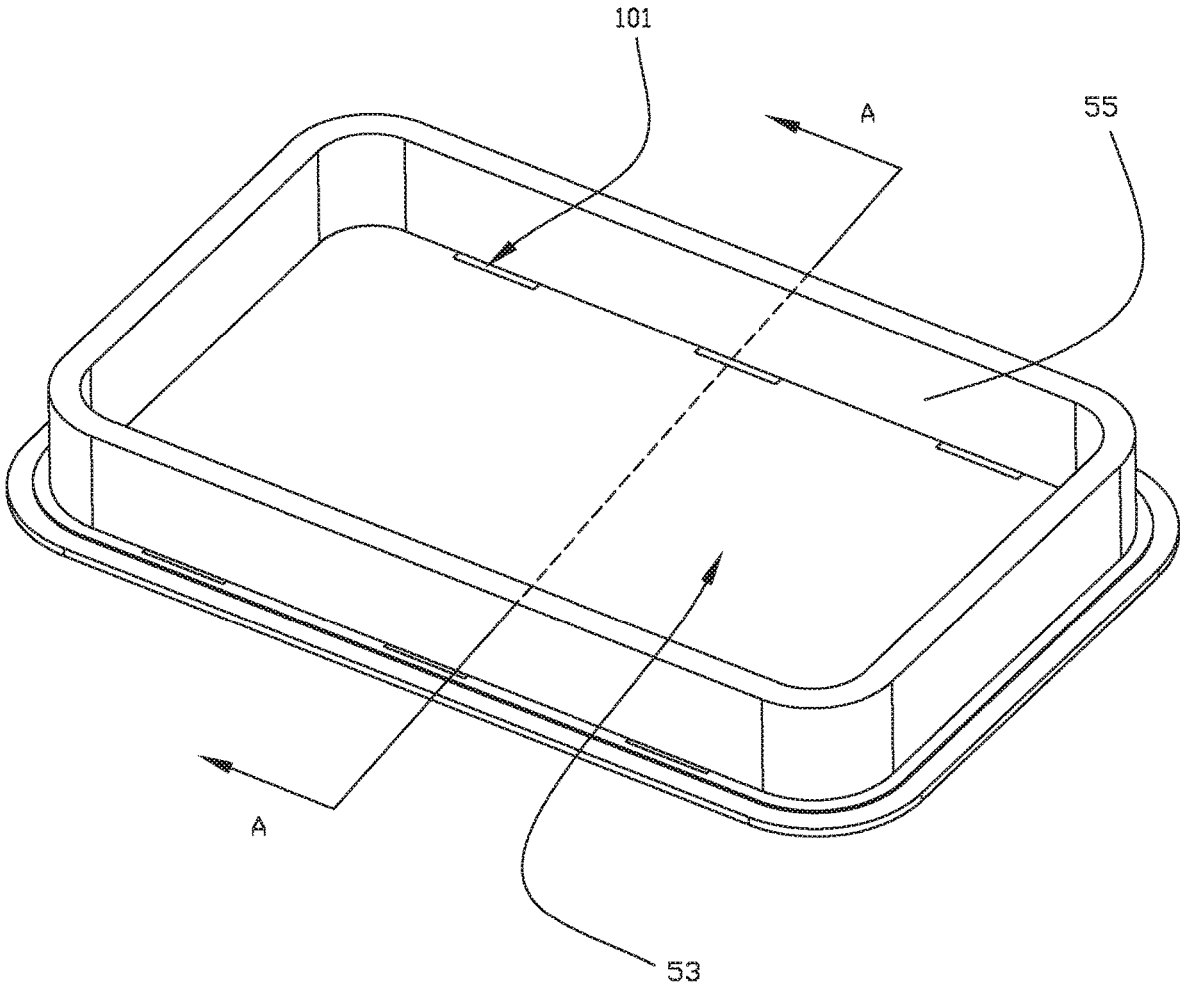
FIG. 4 is an isometric view of a voice coil and a dome of the speaker in the first embodiment.
Figure 5:
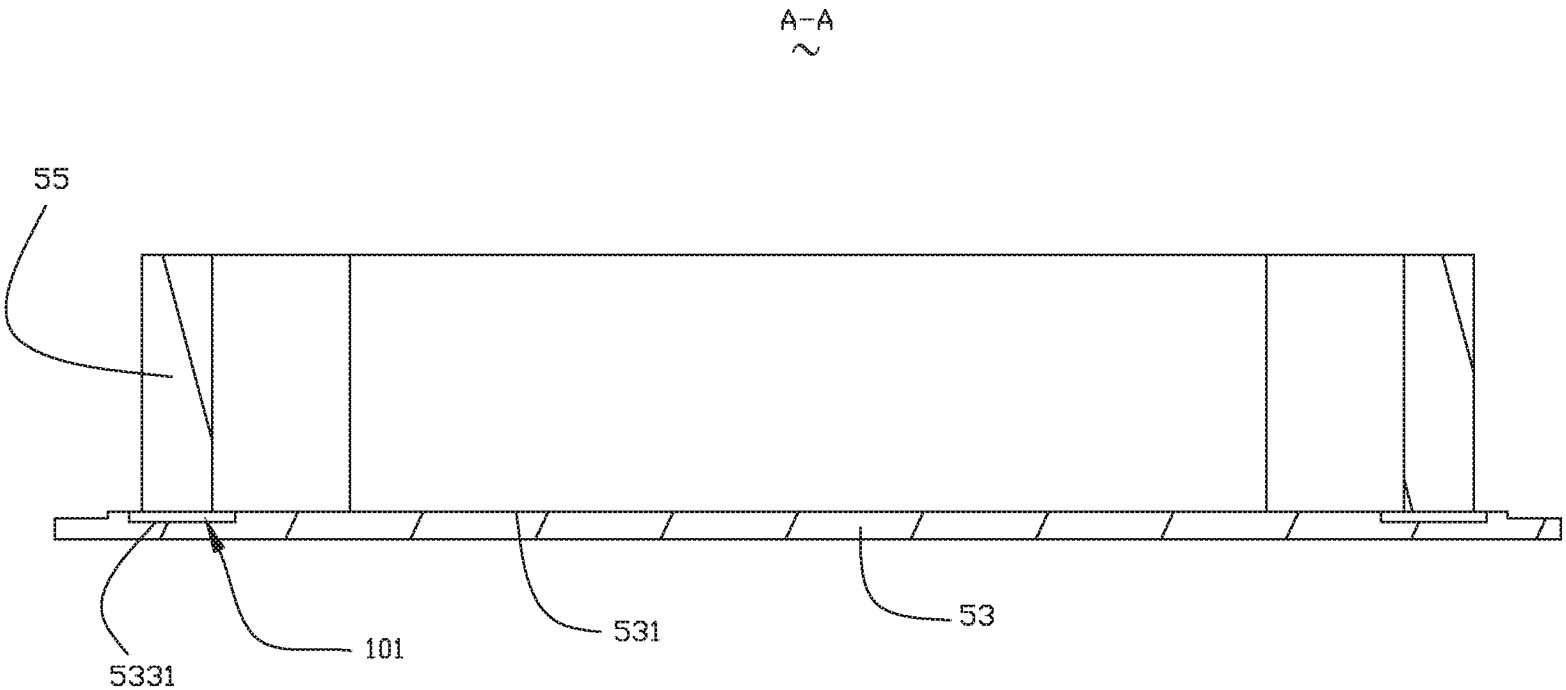
FIG. 5 is a cross-sectional view of FIG. 4, taken along line A-A.

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Embodiment 1

Referring to FIGS. 1-5, the present invention provides a speaker 100. The speaker 100 comprise a frame 10, and a magnetic circuit system 30 and a vibrating system 50 arranged in the frame 10.

The magnetic circuit system 30 comprise a magnetic bowl 31, a main magnet 33 arranged in the magnetic bowl 31, a magnetic guide plate 35 arranged above the main magnet 33, an auxiliary magnet 37 surrounding the main magnet 33, and an upper splint 39 arranged above the auxiliary magnet 37, wherein, the main magnet 33 and the auxiliary magnet 37 form a magnetic gap.

The vibrating system 50 comprise a suspension ring 51 fixed on the frame 10, a dome 53 fixed at the center of the suspension ring 51 and a voice coil 55 connected with the dome 53. The voice coil 55 is inserted into the magnetic gap and drives the dome 53 to vibrate for generating sound.

In the embodiment, the dome 53 is in a fillet rectangle structure. Specifically, the dome 53 comprise an inner surface 531 close to the magnetic circuit system 30, a plurality of grooves 533 concave in the direction far away from the magnetic circuit system 30 from the inner surface 531, a long axis edge 535 oppositely arranged and a short axis edge 537 connected with the long axis edge 535.

The groove 533 comprises a bottom wall 5331. The width of the grooves 533 is greater than the thickness of the voice coil 55, and the voice coil 55 is fixedly connected with the inner surface 531 of the dome 53, and arranged with an interval from the bottom wall 5331 of the grooves 533 to form a leakage passage 101. With the leakage passage 101, the inner and outer air pressure difference of the voice coil 55 can be effectively decreased after the amplitude of the vibrating system 50 increases, and therefore, the influence on the performance of the speaker 100 imposed by the inner and outer air pressure imbalance of the voice coil 55 is avoided.

Preferably, the voice coil 55 and the inner surface 531 are glued for fixed connection. The position of the grooves 533 is not glued so as to prevent glue from blocking the leakage passage 101.

The shape of the grooves 533 of the present invention is not limited, namely, the cross section of the plane of the grooves 533, which is parallel to the inner surface 531, can be rectangular, square, rhombic or round, i.e., the grooves 533 can be in any shape when the leakage passage 101 between the dome 53 and the voice coil 55 is ensured.

Preferably, the concave depth of the grooves 533 is 10~500 um. Over-low concave depth causes over-small leakage passage 101 formed between the voice coil 55 and the dome 53, and the air current in the voice coil 55 cannot circulate well in time. Over-high concave depth decreases the strength of the dome 53 at the position of the grooves 533, which influences the sounding performance of the speaker 100.

Further, one or a plurality of grooves 533 can be arranged. When a plurality of grooves 533 are arranged, the grooves 533 are distributed with intervals in order along the long axis edge 535 and/or the short axis edge 537.

Specifically, in the embodiment, six grooves 533 are arranged, and the six grooves 533 are distributed with intervals in order along the long axis edge 535 and symmetric to the perpendicular bisector of the short axis edge 537.

Based on the structure above, in the embodiment, the dome 53 is a composite material of carbon fiber and foaming material or prepreg resin, such as epoxy resin, PEEK, polyimide, polyphenylene sulfide, PBO, aramid 1414, etc., or the composite material belt of aluminum foil or copper foil and foaming material, wherein, the foaming material includes polymethylacrylimide, methyl cyclopentenolone, foaming polyphenylene sulfide or foaming polyimide. The dome 53 is stamped to form the grooves 533.

Embodiment 2

The speaker provided by the second embodiment is basically the same as the speaker 100 provided by the embodiment 1. The difference is the position of the grooves 60.

Figure 6:
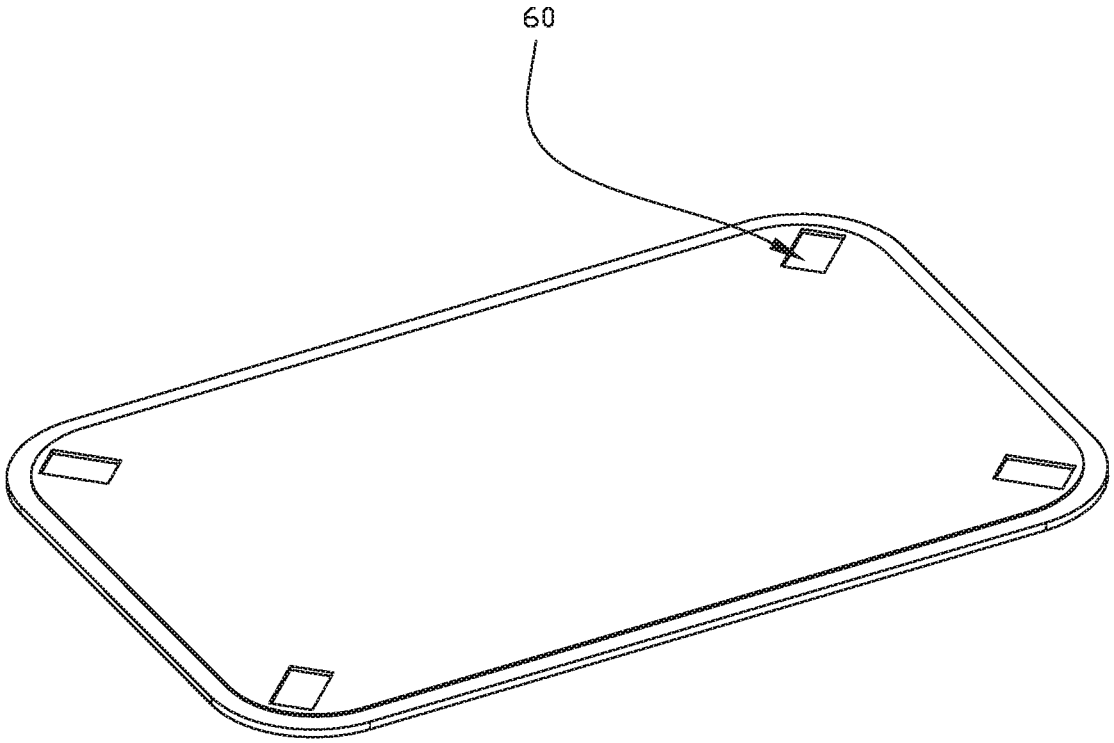
FIG. 6 is an isometric view of a dome of the speaker in accordance with a second exemplary embodiment of the present invention.

Please refer to FIG. 6, in this embodiment, the grooves 60 are distributed at the fillets of the dome. Specifically, four grooves 60 are arranged, and the four grooves 60 are respectively arranged at the four fillets of the dome.

Compared with relevant technologies, the speaker 100 of the present invention arranges the grooves 533 on the dome 53, which forms a leakage passage 101 that helpful for the air current to circulate between the grooves 533 and the voice coil 55, and therefore, the air current in the voice coil 55 can timely circulate through the leakage passage 101 between the voice coil 55 and the dome 53, the inner and outer air pressure difference of the voice coil 55 can be effectively decreased after the amplitude of the vibrating system 50 increases, and the influence on the performance of the speaker 100 imposed by the unbalance of the inner and outer air pressures of the voice coil 55 is avoided. At the same time, the leakage passage 101 is provided by arranging the grooves 533, which avoids the change the thickness of the dome 53 caused by the leakage passage 101 and ensures the excellent performance and reliability of the speaker 100.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker, including:

a frame;

a magnetic circuit system arranged in the frame;

a vibrating system arranged in the frame, having a suspension ring fixed on the frame, a dome fixed at a center of the suspension ring, and a voice coil connected with the dome;

the dome comprising an inner surface close to the magnetic circuit system, and a plurality of grooves concave in a direction far away from the magnetic circuit system from the inner surface; wherein the groove comprises a bottom wall, a width of the groove is greater than a thickness of the voice coil; and the voice coil is fixedly connected with an inner surface of the dome, and keeps a distance from the bottom wall of the groove.

2. The speaker according to claim 1, wherein the dome is in a fillet rectangle structure, and further comprises a pair of long axis edge oppositely arranged and a pair of short axis edge connected with the long axis edge; the plurality of grooves are distributed with intervals therebetween in an order along the long axis edge and/or the short axis edge.

3. The speaker according to claim 2, wherein a cross section of the grooves parallel to the inner surface is rectangular, square, rhombic or round.

4. The speaker according to claim 3, wherein a concave depth of the grooves is 10 to 500 um.

5. The speaker according to claim 2 comprising six grooves, wherein the six grooves are distributed with intervals in an order along the long axis edge and symmetric to a perpendicular bisector of the short axis edge.

6. The speaker according to claim 5, wherein a cross section of the grooves parallel to the inner surface is rectangular, square, rhombic or round.

7. The speaker according to claim 6, wherein a cross section of the grooves parallel to the inner surface is rectangular, square, rhombic or round.

8. The speaker according to claim 1, wherein the dome is in a fillet rectangle structure;

the dome further comprises a pair of long axis edge oppositely arranged and a pair of short axis edge connected with the long axis edge; the plurality of grooves are distributed on the fillets of the dome.

9. The speaker according to claim 8, wherein a cross section of the grooves parallel to the inner surface is rectangular, square, rhombic or round.

10. The speaker according to claim 9, wherein a cross section of the grooves parallel to the inner surface is rectangular, square, rhombic or round.

11. The speaker according to claim 8 comprising four grooves, wherein the four grooves are respectively arranged at the four fillets of the dome.

12. The speaker according to claim 11, wherein a cross section of the grooves parallel to the inner surface is rectangular, square, rhombic or round.

13. The speaker according to claim 12, wherein a cross section of the grooves parallel to the inner surface is rectangular, square, rhombic or round.

14. The speaker according to claim 1, wherein a cross section of the grooves parallel to the inner surface is rectangular, square, rhombic or round.

15. The speaker according to claim 14, wherein a concave depth of the grooves is 10 to 500 um.

16. The speaker according to claim 1, wherein the voice coil and the inner surface are fixedly connected by glue.

17. The speaker according to claim 1, wherein the dome is made of a composite material of carbon fiber and foaming material selected from at least one of epoxy resin, PEEK, polyimide, polyphenylene sulfide, PBO, and aramid, or made of composite material belt of aluminum foil or copper foil and foaming material.

18. The speaker according to claim 17, wherein the foaming material includes polymethylacrylimide, methyl cyclopentenolone, foaming polyphenylene sulfide or foaming polyimide.

* * * * *